US007030852B2

(12) United States Patent
Ito et al.

(10) Patent No.: US 7,030,852 B2
(45) Date of Patent: Apr. 18, 2006

(54) LIQUID CRYSTAL DISPLAY UNIT HAVING INCOMING PIXEL DATA REARRANGEMENT CIRCUIT

(75) Inventors: Masahiro Ito, Tokyo (JP); Kazuhiko Takami, Tokyo (JP); Noboru Okuzono, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 386 days.

(21) Appl. No.: 10/122,240

(22) Filed: Apr. 16, 2002

(65) Prior Publication Data

US 2002/0149550 A1 Oct. 17, 2002

(30) Foreign Application Priority Data

Apr. 16, 2001 (JP) ..... 2001-117002

(51) Int. Cl.
*G09G 3/36* (2006.01)

(52) U.S. Cl. ..... 345/103; 345/100; 345/204

(58) Field of Classification Search ..... 345/103, 345/87, 1.1, 98, 99, 100, 90, 204
See application file for complete search history.

(56) References Cited

U.S. PATENT DOCUMENTS 5,929,925 A * 7/1999 Nakamura et al. ..... 348/556
6,545,655 B1 * 4/2003 Fujikawa ..... 345/87
6,611,261 B1 * 8/2003 Zhang et al. ..... 345/204
6,621,480 B1 * 9/2003 Morita ..... 345/99
6,750,838 B1 * 6/2004 Hirakata ..... 345/98

FOREIGN PATENT DOCUMENTS

| | | |
|---|---|---|
| JP | A 5-210359 | 8/1993 |
| JP | 10-149140 | 6/1998 |
| JP | A 10-207434 | 8/1998 |
| KR | A 1999-009631 | 2/1999 |
| KR | A 1999-016489 | 3/1999 |

* cited by examiner

*Primary Examiner*—Regina Liang
*Assistant Examiner*—Jennifer T. Nguyen
(74) *Attorney, Agent, or Firm*—Young & Thompson

(57) ABSTRACT

A liquid crystal display (LCD) panel unit is provided with a plurality of source drivers which are functionally divided into first and second source driver groups respectively assigned to first and second halves of an LCD panel. In order to properly drive the LCD panel irrespective of incoming pixel data of different formats, a pixel data rearrangement circuit is provided for rearranging the incoming pixel data to a predetermined data format. The data rearrangement circuit precedes the first and second source driver groups, and functions such as to receive 2N-path (N is a natural number) pixel data and rearranges the orders of the 2N-path pixel data according to the predetermined data format, and applies the rearranged N-path pixel data to the first source driver group and applying the rearranged other N-path pixel data to the second source driver group.

7 Claims, 14 Drawing Sheets

DATA FORMAT 1

DATA FORMA 2

OUTPUT OF PIXEL DATA REARRANGEMENT CIRCUIT

IN THE CASE OF DATA FORMAT 1

DATA FORMAT 1

DATA FORMAT 2

OUTPUT OF PIXEL DATA REARRANGEMENT CIRCUIT

IN THE CASE OF DATA FORMAT 1

LIQUID CRYSTAL DISPLAY UNIT HAVING INCOMING PIXEL DATA REARRANGEMENT CIRCUIT

BACKGROUND OF THE INVENTION

1. Field of the Invention

The present invention relates generally to an active-matrix addressed liquid crystal display (LCD) unit, and more specifically to such a unit having a pixel data rearrangement circuit for ordering incoming pixel data to a predetermined format in order to properly drive an LCD panel.

2. Description of Related Art

LCDs have found extensive uses in a variety of electronic devices such as television receivers, personal computers, personal digital assistances (PDAs), mobile telephone terminals, picture monitors, and so on. Among others, active-matrix addressed LCDs have widely utilized, which are provided with a plurality of active elements (switching elements) respectively assigned to pixel electrodes for controlling application of voltages thereto. The active element is typically a thin film transistor (TFT). The active-matrix addressed LCD has distinct features of high resolution, a wide viewing angle, a high contrast, multi-gradation, etc.

With the developments of LCD manufacturing technology, it is a current tendency that the LCD panel becomes large while maintaining or increasing pixel density. Accordingly, the number of pixels per line increases and it becomes necessary to increase a timing clock frequency. However, as the timing clock becomes higher, the conventional LCD device has encountered the difficulties that the manufacturing cost of the source drivers becomes higher and that EMI (electromagnetic interference) has become noticeable.

In order to address the above-mentioned problems, it has been proposed to divide the source drivers into two groups to which the pixel data are applied in parallel. Therefore, it is possible to halve the clock frequency. Such proposal is disclosed in Laid-Open Japanese Patent Applications Nos. 5-210359 and 10-207434.

Before turning to the present invention, it is deemed advantageous to briefly described, with reference to FIG. 1, the conventional technology disclosed in the aforesaid Japanese Patent Application No. 5-210359.

FIG. 1 is a block diagram showing an LCD panel 2 and peripheral blocks. The LCD panel 2 carries a plurality of source drivers 3 at the periphery thereof for driving TFTs provided in matrix in the panel 2. The source drivers 3 are divided into two groups: one group 3L is assigned to the left half of the LCD panel 2 and the other group 3R to the right half of the panel 2. One path of pixel data is applied to an interface 4 at which the incoming pixel data is divided into two-path pixel data S1 and S2 using a clock CK1. This clock CK1 is also applied to a frequency divider 5 that halves the clock rate of the clock CK1 and issues the frequency (rate) halved clock as a clock CK2.

A controller 6 is supplied with the two-path pixel data S1 and S2 using the clock CK2, and applies these data to the source driver groups 3L and 3R as S1U and S2U, respectively. In addition, the controller 6 prepares a sampling start signal SP using the pixel data S1 or S2, and applies the signal SP to the leading source driver of each of the driver groups 3L and 3R. Thus, the pixel data S1U and S2U are displayed in parallel. As mentioned above, this prior art features that the source drive timing clock can be halved. This means that a large LCD panel can be driven without increase in the timing clock, and at the same time, the EMI problems can be reduced.

As mentioned above, the aforesaid prior art is supplied with a single path pixel data and then divides the same into two-path pixel data for the left and right source drivers 3L and 3R. Meanwhile, it is typical that the LCD panel manufacturer produces, as a unit, the LCD panel 2, the interface 4, and the controller 6. Therefore, the LCD device makers, who purchase such LCD panel units, are undesirably obliged to prepare the pixel data that has been previously determined by the LCD panel manufacturer, which reduces the degree of freedom in circuit design. It is not rare that the LCD device maker wishes to apply a plurality of paths of pixel data with different data formats to the LCD panel unit. However, the above-mentioned prior art is unable to comply with such requirements of the users. Other prior art, the Laid-Open Japanese Patent Application No. 10-207434, suffers from the same difficulties as mentioned above.

SUMMARY OF THE INVENTION

It is therefore an object of the present invention to provide an LCD panel unit which incorporates thereinto an improved circuit for rearranging a plurality of paths of incoming pixel data to a data format for driving two source driver groups.

In brief, these objects are achieved by the techniques wherein a liquid crystal display (LCD) panel unit is provided with a plurality of source drivers which are functionally divided into first and second source driver groups respectively assigned to first and second halves of an LCD panel. In order to properly drive the LCD panel irrespective of incoming pixel data of different formats, a pixel data rearrangement circuit is provided for rearranging the incoming pixel data to a predetermined data format. The data rearrangement circuit precedes the first and second source driver groups, and functions such as to receive 2N-path (N is a natural number) pixel data and rearranges the orders of the 2N-path pixel data according to the predetermined data format, and applies the rearranged N-path pixel data to the first source driver group and applying the rearranged other N-path pixel data to the second source driver group.

One aspect of the present invention resides in a liquid crystal display (LCD) unit, comprising: an LCD panel; a plurality of source drivers functionally divided into first and second source driver groups which are respectively assigned to first and second halves of the LCD panel; and a pixel data rearrangement circuit preceding the first and second source driver groups, the pixel data rearrangement circuit receiving 2N-path (N is a natural number) pixel data and rearranging the orders of the 2N-path pixel data according to a predetermined data format and applying rearranged first N-path pixel data to the first source driver group and applying rearranged second N-path pixel data to the second source driver group.

BRIEF DESCRIPTION OF THE DRAWINGS

The features and advantages of the present invention will become more clearly appreciated from the following description taken in conjunction with the accompanying drawings in which like elements or portions are denoted by like reference numerals and in which.

DETAILED DESCRIPTION OF THE PREFERRED EMBODIMENTS

Figure 1:
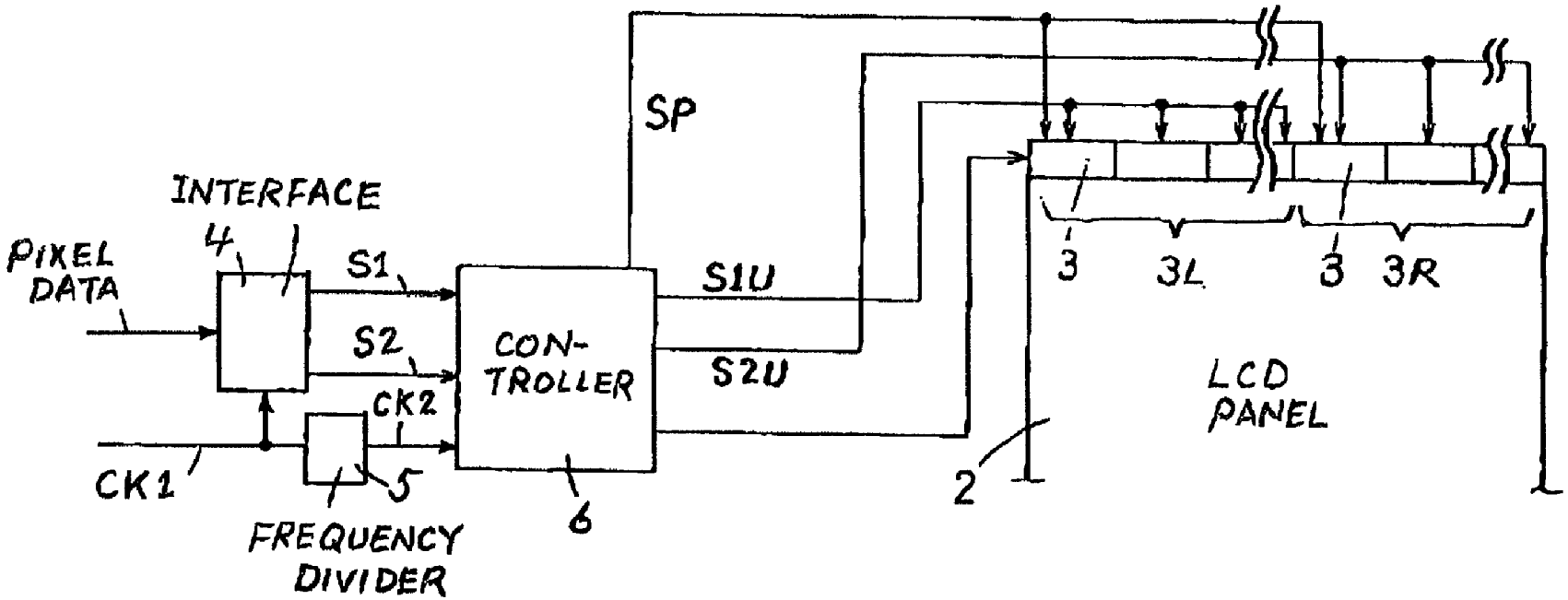
FIG. 1 (PRIOR ART)
FIG. 1 is a block diagram schematically showing a conventional arrangement of an LCD panel and the peripheral units thereof, having been referred to in the opening paragraphs.
Figure 2:
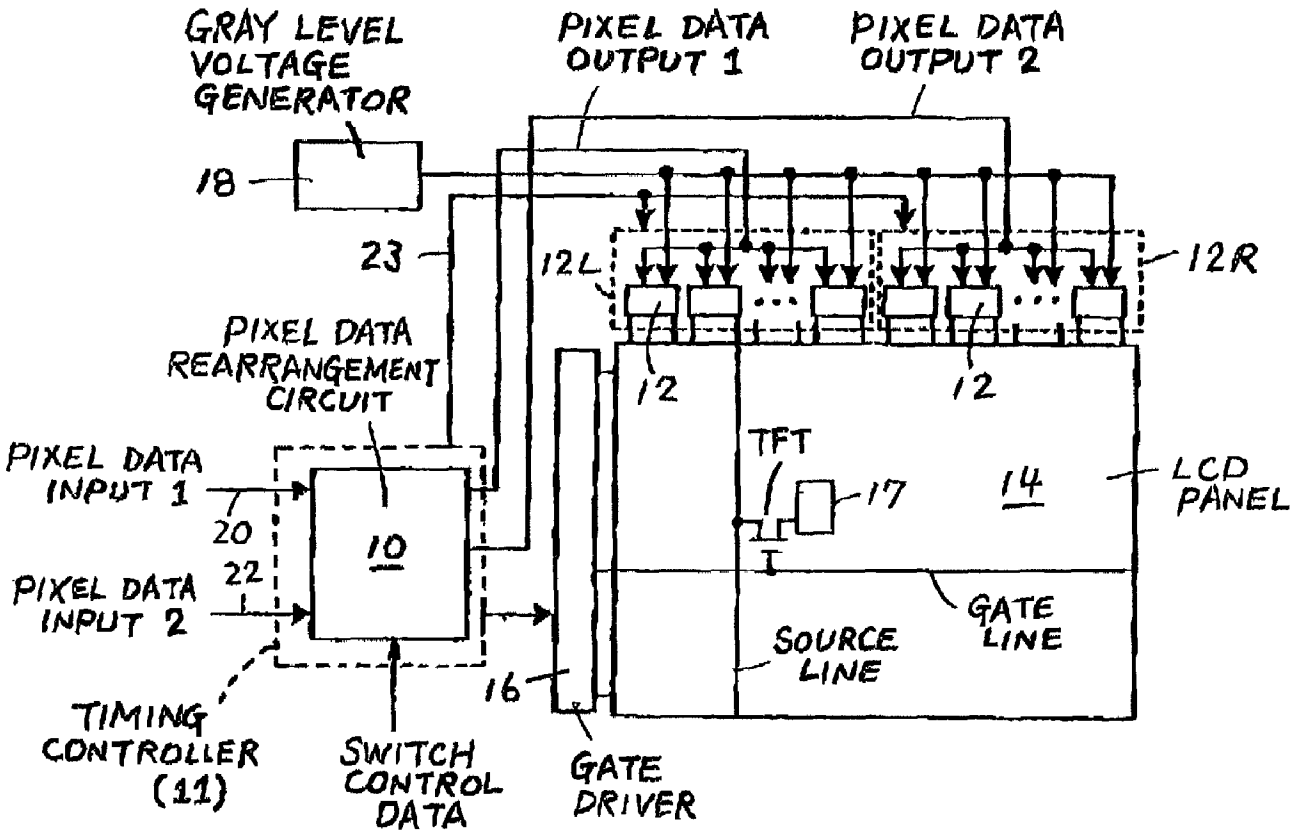
FIG. 2 is a block diagram schematically showing a LCD panel unit according to a first embodiment of the present invention.

A first embodiment of the present invention will be described with reference to FIGS. 2–8. Referring first to FIG. 2, a pixel data rearrangement circuit (or unit) 10, which is directly concerned with the present invention, is provided in a timing controller 11. The circuit 10 precedes a plurality of source drivers 12 provided at one edge (peripheral) of a liquid crystal (LCD) panel 14. As is well known in the art, the LCD panel 14 is equipped with a plurality of active elements (switching elements) in matrix, each of which typically takes form of a thin film transistor (TFT) and is positioned in the vicinity of a cross point of a source (or data) line and a gate line (extending from a gate driver 16), as schematically illustrated in FIG. 2. The TFT is rendered active in response to a switch-on voltage appearing on the gate line, whereby a data voltage is applied to a pixel electrode 17 by way of the activated TFT.

According to the first embodiment, the plurality of source drivers 12 are divided into two groups (sections) 12L and 12R. One group 12L is assigned to the left half of the LCD panel 14 and the other group 12R to the right half of the LCD panel 14. A gray level voltage generator 18 is provided which issues a plurality of gray level voltages which are applied to the source drivers 12. The gray levels may be 8, 16, 32, . . . , or 256 for example, one of which is selected In response to sub-pixel data (viz., one of red (R), green (G) and blue (B) data) applied from the pixel data rearrangement circuit 10. The gray level per se is well known in the art, and accordingly, the further descriptions thereof will be omitted for simplifying the instant disclosure.

The pixel data rearrangement circuit 10 is supplied with two pixel data inputs 1 and 2 via two pixel data channels (or paths) 20 and 22, and rearranges the orders of the applied pixel data so as to correctly drive the source drivers 12 which are divided into the two groups 12L and 12R.

The timing controller 11 functions such as to extract a start signal (horizontal sync signal) 23 from one of the pixel data 1 and 2, and applies the signal 23 to both of the source driver groups 12L and 12R. As an alternative, the above-mentioned start signal may be prepared at a suitable circuit which precedes the controller 11 and then applied to the timing controller 11 in parallel with the pixel data 1 and 2. The timing controller 11, in addition to the above, generates a gate driver control signal. The generation of these signals (viz., start signal and gate driver control signal), which is well known in the art, is not directly concerned with the present invention, and as such, the details thereof will be omitted for brevity.

Figure 3A:
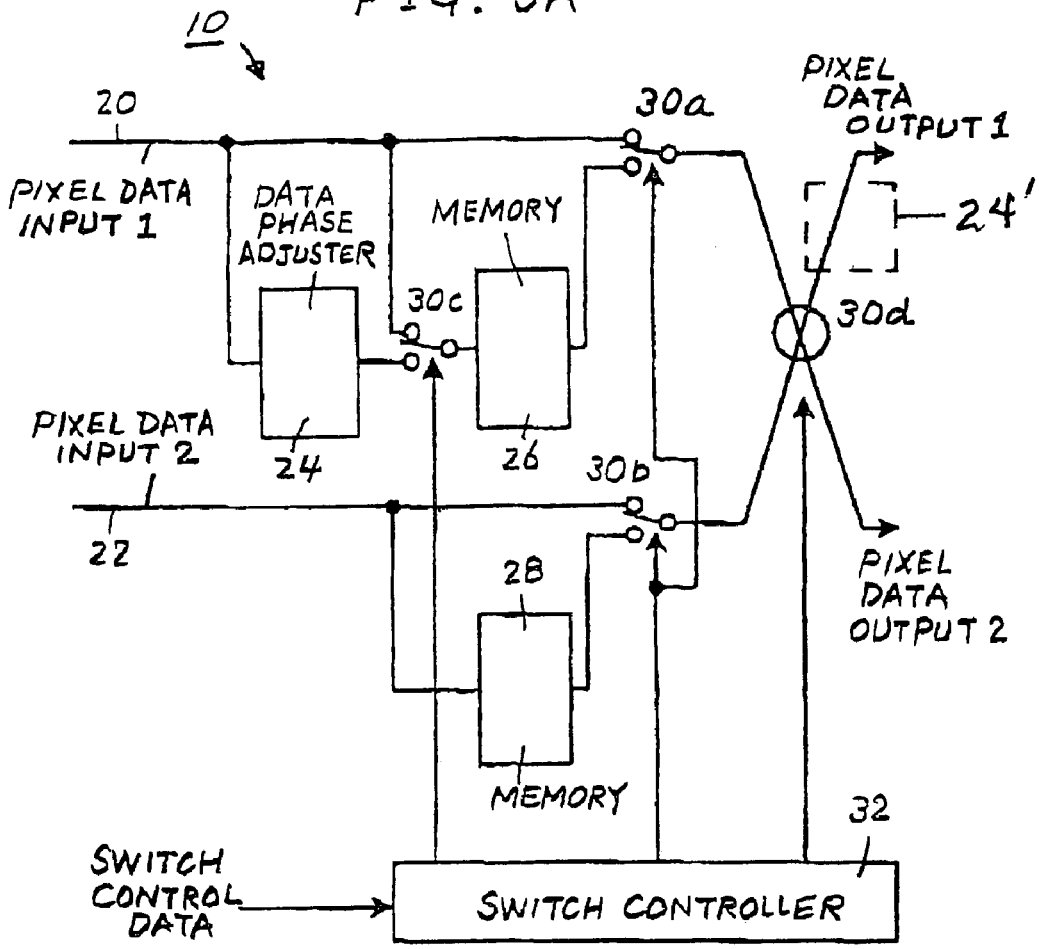
FIG. 3A is a block diagram showing the detail of a pixel data rearrangement circuit shown in FIG. 2.
Figure 3B:
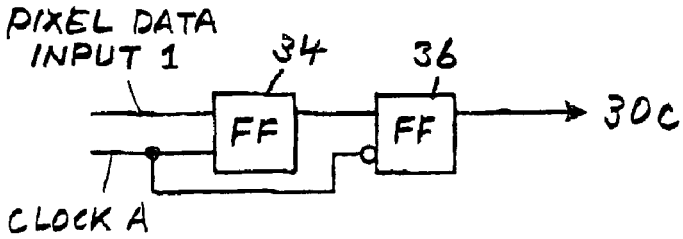
FIG. 3B is a block diagram showing one concrete example of a block of FIG. 3A.

Reference is made to FIGS. 3A and 3B, the pixel data rearrangement controller 10 is illustrated in detail. As shown, the controller 10 comprises a data phase adjuster 24, two memories 26 and 28 each of which includes a plurality of line memories (not shown in FIG. 3A), four switches 30*a*–30*d*, and a switch controller 32. This controller 32, using the switch control data previously applied thereto from external, controls on-off operations of the switches 30*a*–30*d*. FIG. 3B shows one example of the data phase adjuster 24 which comprises two flip-flops 34 and 36 in this particular case. It is understood that the operations of the controller 10 of FIG. 3A, such as the data write into the memories 34*a*–34*d* and data read therefrom and phase data control, are all carried out under the control of a timing clock. However, in order to simplify the drawing, the application of the clock to the blocks is not illustrated in FIG. 3A.

The operations of the pixel data rearrangement circuit 10 will be described with reference to FIGS. 3A–3B, 4A–4D, and 5–7. Three kinds of formats of the pixel data inputs 1 and 2 are exemplified in FIGS. 4A–4C, wherein it is assumed that the number of pixel data in one horizontal line is 2M which are numbered 0, 1, 2, . . . , 2M−1. As is known, the number of bits of each pixel data except for control bits is equal to three times (viz., R, G, and B) the number of the bits for gray levels. In FIGS. 4A–4D, clock A is used to control the processing of each pixel data, and clock B is phase-shifted (or delayed) by ½ clock relative to clock A. FIG. 4D shows the data formats of the outputs 1 and 2 to be outputted from the pixel data rearrangement circuit 10. In other words, the pixel data inputs 1 and 2 should be rearranged as shown in FIG. 4D.

Figure 4A:
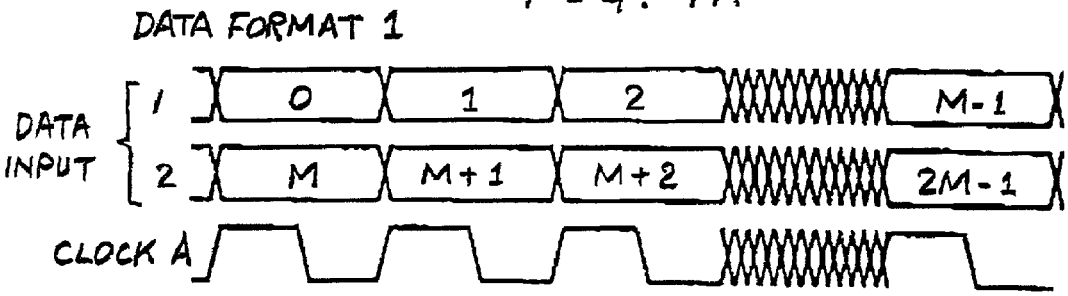
FIGS. 4A to 4D are each showing a timing chart for describing the operations of the circuit shown in FIG. 3A.

In the case where the pixel data inputs 1 and 2 are applied to the circuit 10 with the data format shown in FIG. 4A, there is no need to rearrange the order of pixel data. As such, the switch controller 32 sets, in accordance with the switch control data previously applied thereto, the switches 30*a* and 30*b* so as to directly select the pixel data inputs 1 and 2, and also sets the switch 30*d* such as to pass the outputs of the switches 30*a* and 30*b* as the pixel data outputs 1 and 2. In this instance, there is no need to control the switch 30*c*.

Figure 4B:
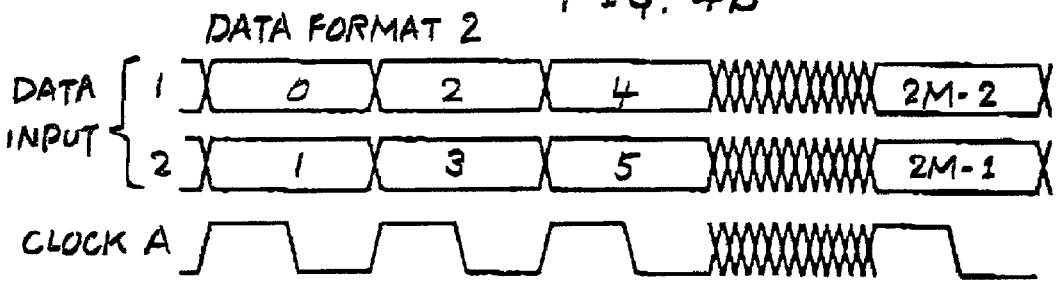

When the pixel data inputs 1 and 2 respectively take the formats shown in FIG. 4B, the switch controller 32 sets the switch 30*c* so as to apply the pixel data input 1 to the memory 26, and sets the switches 30*a* and 30*b* so as to select the outputs of the memories 28 and 28. Further, the switch 30*d* is controlled such as to alternately select the pixel data stored in the memories 26 and 28 in order to rearrange the pixel data to take the formats shown in FIG. 4D. The data rearrangement of this case will be described in more detail with reference to FIGS. 5–7.

Figure 4C:
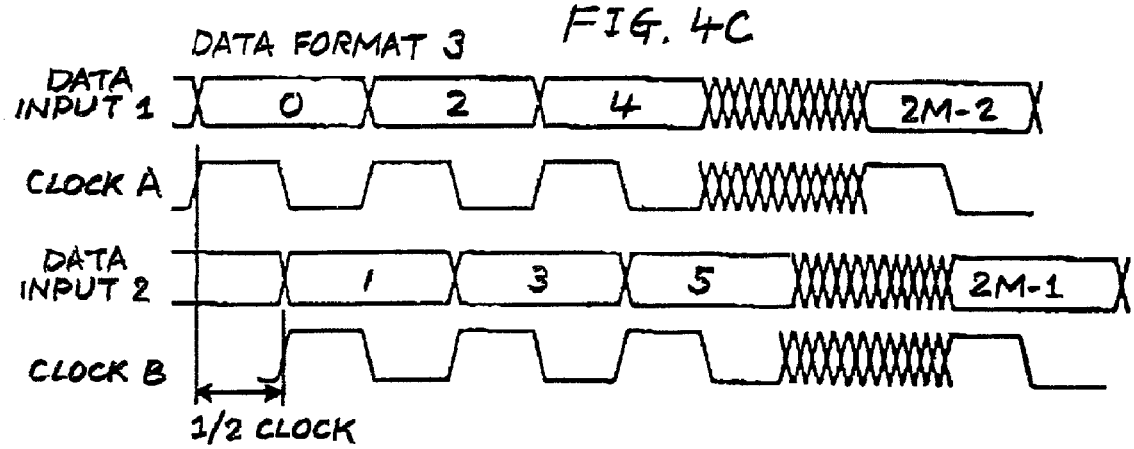
Figure 4D:
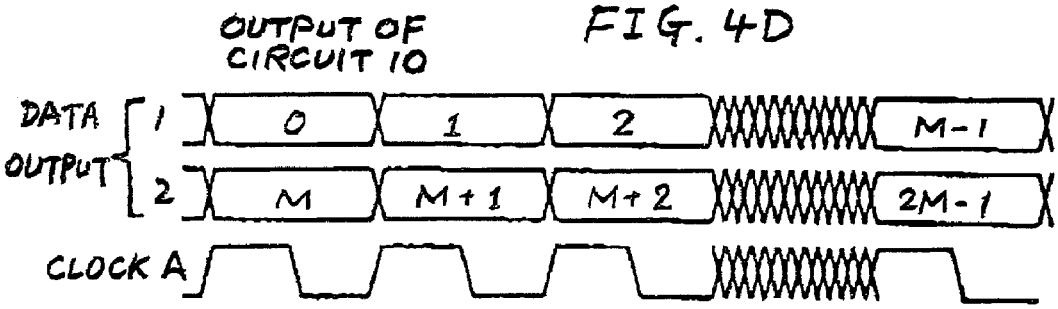

Referring to FIG. 4C, the pixel data inputs 1 and 2 are arranged in exactly the same manner as those in FIG. 4B. However, the input 2 is delayed by ½ clock relative to the input 1. In this instance, the switch controller 32 controls the switch 30*c* to select the data phase adjuster 24 at which the data input 1 is delayed by ½ clock, thereby to render identical the two phases of the pixel data inputs 1 and 2. The data phase adjuster 24 can be realized using relatively simple conventional circuitry as shown in FIG. 3B by way of example. The pixel data is acquired into the flip-flop 34 in response to a falling edge of clock A, after which the pixel data stored in the flip-flop 34 is acquired into the next flip-flop 36 at a rising edge of clock A in that clock A is reversed when applied to the flip-flop 36, whereby the data input 1 is delayed by ½ clock. The following operations of the case shown in FIG. 4C are identical to those having been described with reference to the data format 2 of FIG. 4B.

Figure 5:
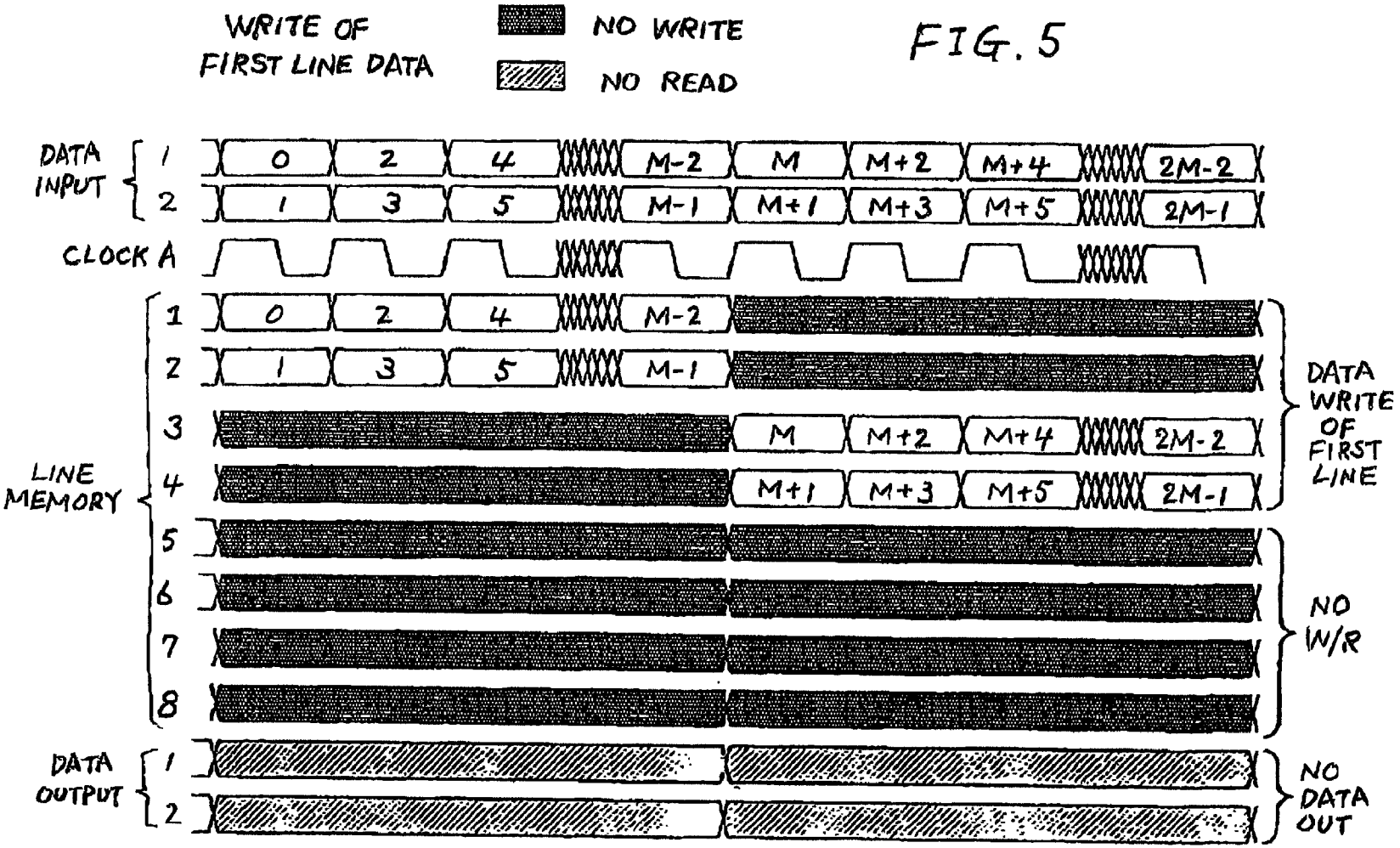
FIGS. 5 to 7 are each showing a timing chart for further describing the operations of the circuit shown in FIG. 3A.
Figure 6:
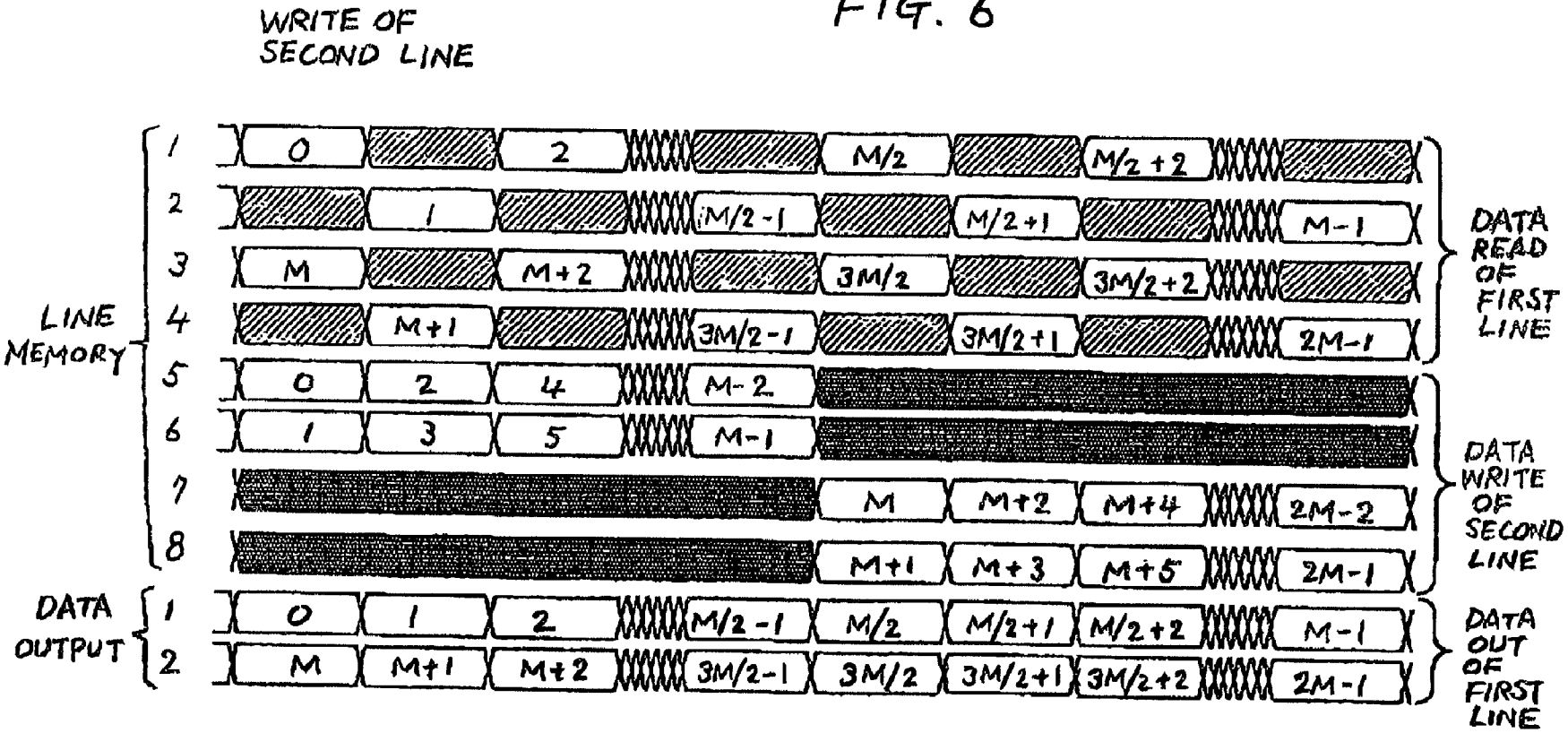
Figure 7:
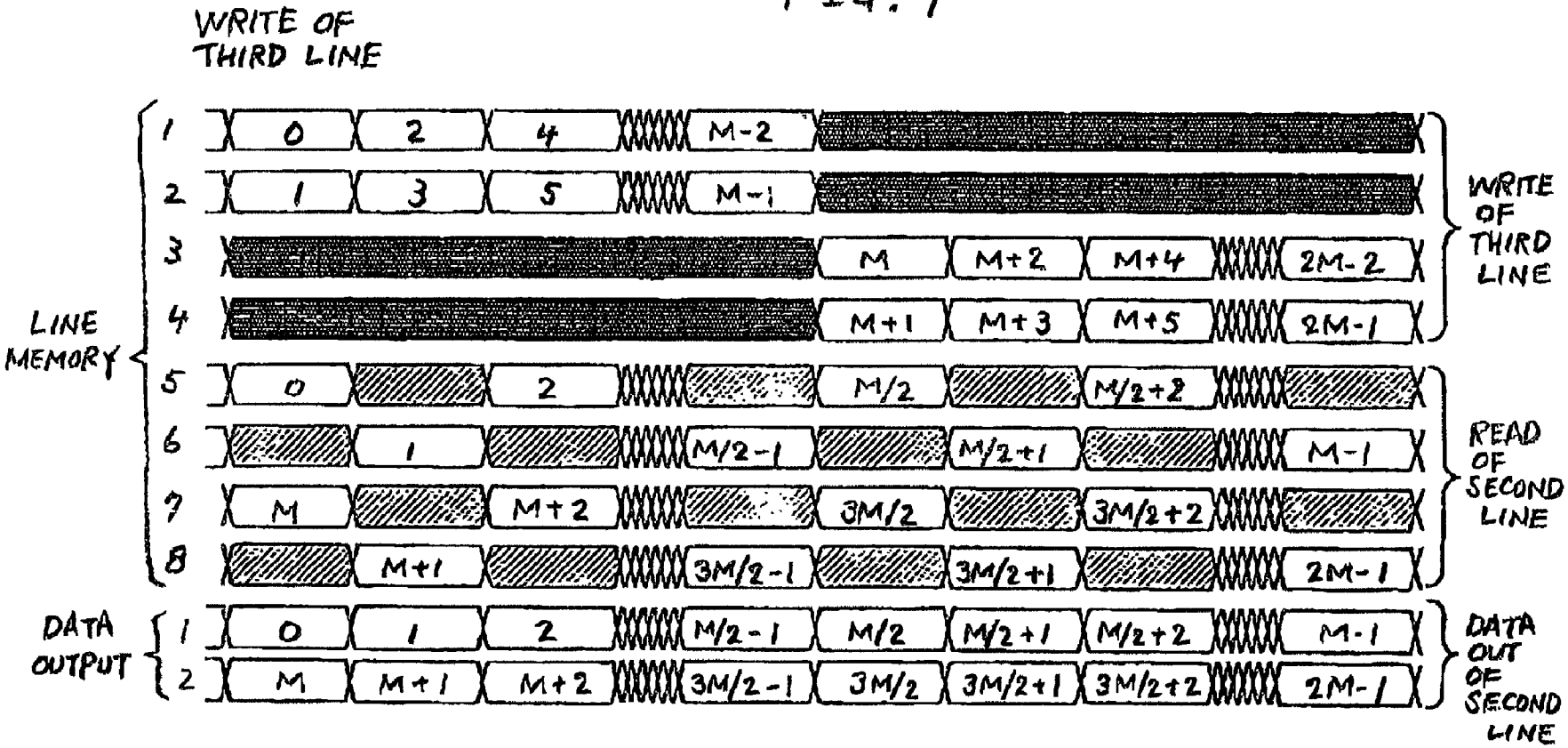

Referring to FIGS. 5–7, there are shown timing charts for discussing memory read/write operations and data arrangement of the data inputs 1 and 2 formatted as shown in FIG. 4B. As mentioned above, each of the memories 26 and 28 is provided with a plurality of line memories, the number of which is four (viz., eight in total) in the case where the number of pixel data inputs are two as mentioned above. It is assumed that the line memories 1–4 and 5–8 are respectively provided in the memories 26 and 28.

FIG. 5 shows the memory write operations of the first line data of the data inputs 1 and 2. As shown, the first half of the pixel data 0, 2, . . . , M−2 at the first line of the input 1 are successively wrote into the line memory 1, and likewise, the first half of the pixel data 1, 3, . . . , M−1 at the first line of the input 2 are successively wrote into the line memory 2. Subsequently, the second half of pixel data M, M+2, . . . , 2M−2 at the first line of the input 1 are successively wrote into the line memory 3, and in a similar manner, the second half of pixel data M+1, M+3, . . . , 2M−1 at the first line of the input 2 are successively stored in the line memory 4. During these operations, no data write/read operations are implemented with respect to the remaining line memories 5–8, and further, there is no data output from the pixel data rearrangement circuit 10 (FIGS. 2 and 3A).

FIG. 6 shows the memory write operations of the second line data of the data inputs 1 and 2, together with the memory read operations of the first line data of the data inputs 1 and 2. The write operations of the second line data into the line memories 5–8 are carried out in exactly the same manner except that the line memories utilized are different, and as such, the further descriptions thereof are deemed redundant and accordingly omitted for brevity. In parallel with the above-mentioned write operations of the second line, the pixel data of the first line already stored in the line memories 1–4 are read out of the line memories 1–4 as shown in FIG. 6. Therefore, the pixel data rearrangement circuit 10 is able to rearrange the first line data of the inputs 1 and 2 and generate the data outputs 1 and 2 with the predetermined formats shown in FIG. 4D.

FIG. 7 shows the memory write operations of the third line data of the data inputs 1 and 2, together with the memory read operations of the second line data. These operations can readily be understood from the aforesaid descriptions.

Figure 8:
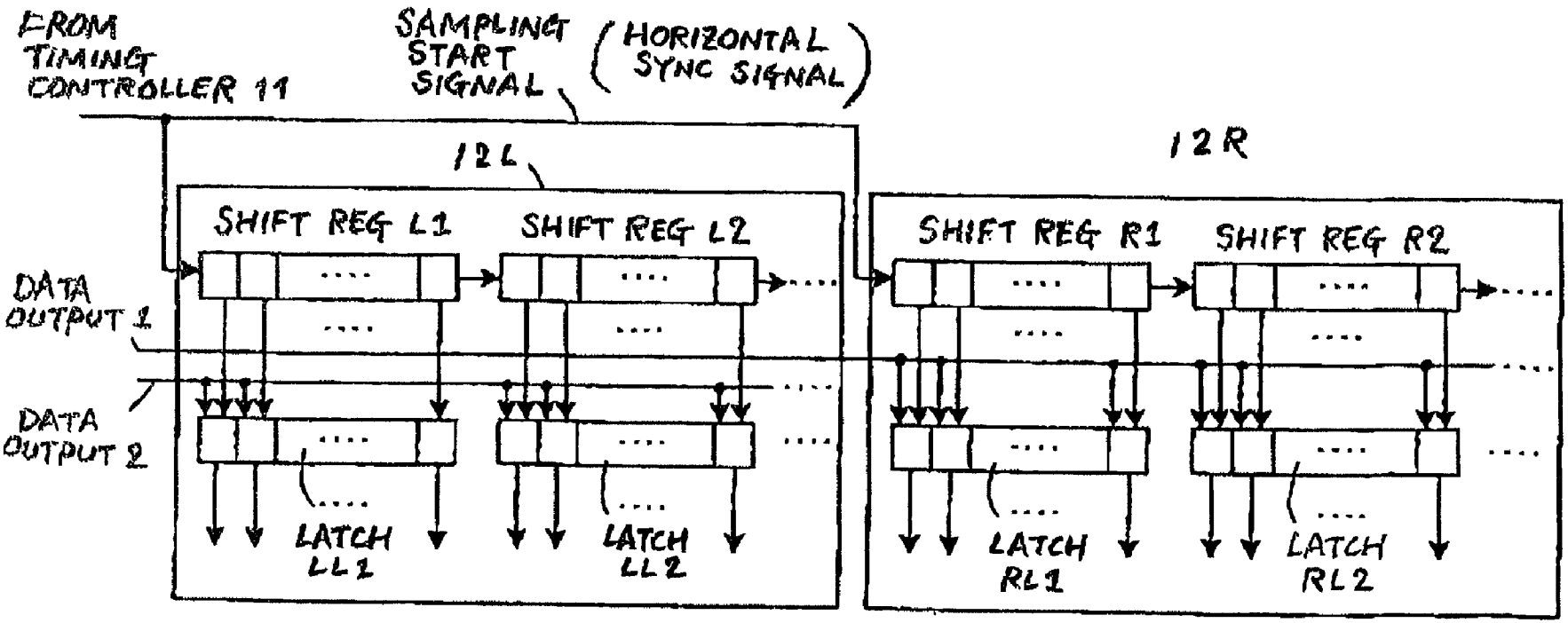
FIG. 8 is a block diagram showing part of source drivers for an LCD panel of FIG. 2.

FIG. 8 is a diagram schematically showing part of each of the source drivers 12L and 12R. The start signal (viz., horizontal sync signal) is applied to the first stage of each of the shift registers L1 and R1, after which the start signal is shifted or displaced to the right, and then to the next shift register L2 and R2 respectively in response to a shift pulse (not shown). The start signal thus shifted is applied to corresponding stages of latches LL1, LL2, . . . , and RL1, RL2, . . . . Each of these latches is provided with multiple stages whose number is equal to that of the corresponding shift register. The latches LL1, LL2, RL1, RL2, etc., in response to the start signal and the timing clock (viz., clock A), successively latch the pixel data of the outputs 1 and 2 both generated from the pixel data rearrangement circuit 10. After the whole pixel data of one line are stored in the latches LL1, LL2, . . . , RL1, RL2, . . . , the latched pixel data are used to determined gray level voltages, and subsequently the gray level voltages are applied to the corresponding active elements such as TFTs as is well known in the art.

A second embodiment of the present invention will be described with reference to FIGS. 9, 10, and 11A–11F. A pixel data rearrangement circuit 110 (FIG. 9) according to the second embodiment receives four pixel data inputs 1 to 4, and generates four pixel data outputs 1 to 4 after rearranging the orders of the inputted data to predetermined ones. Thus, the second embodiment differs from the first embodiment in terms of the number of Input and output data.

Figure 9:
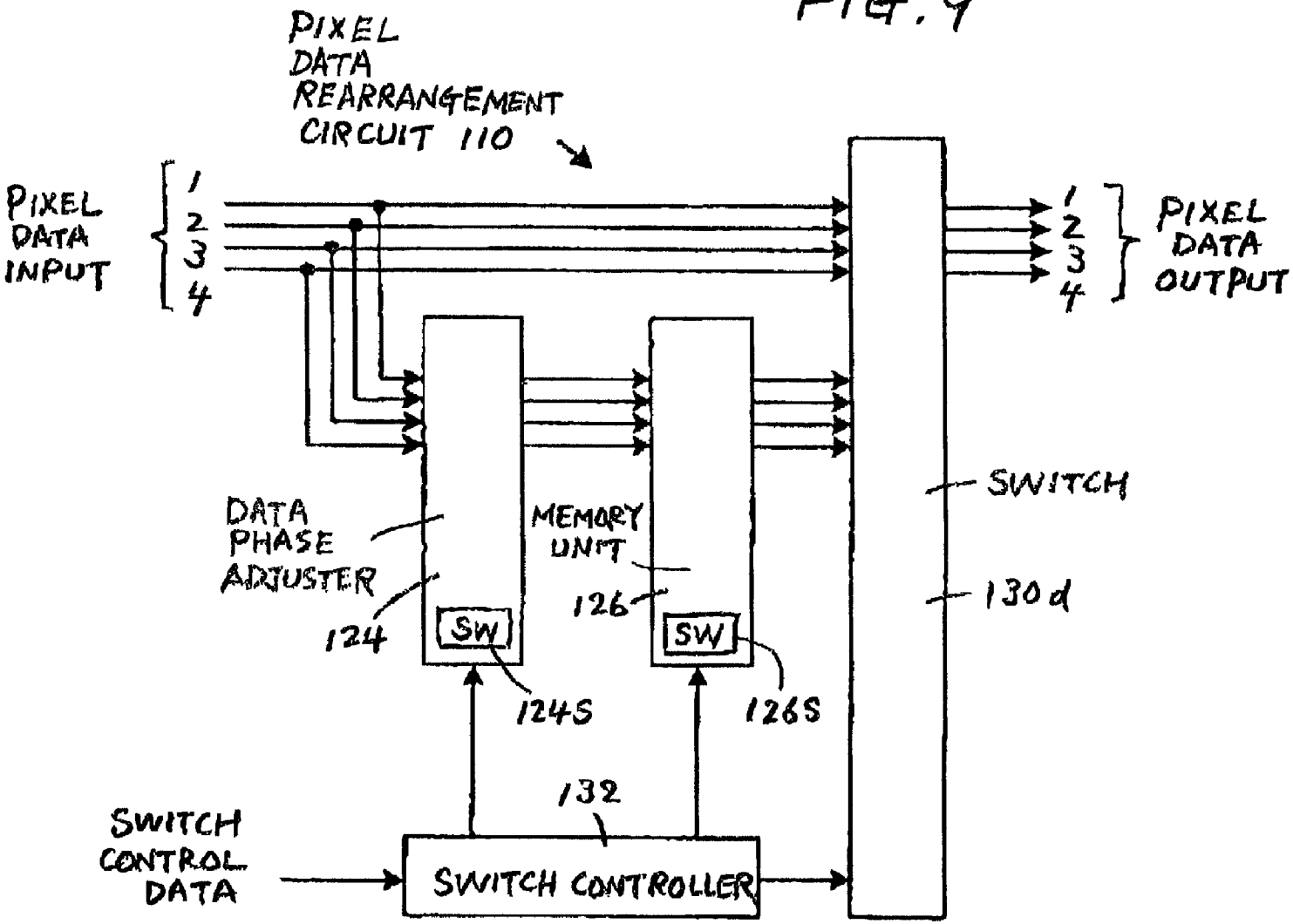
FIG. 9 is a block diagram schematically showing a pixel data rearrangement circuit according to a second embodiment of the present invention.

As shown in FIG. 9, the four pixel data inputs 1 to 4, which may take different formats as exemplified in FIGS. 11A–11E, are applied to the data rearrangement circuit 110. This circuit 110 generally comprises a data phase adjuster 124 having switches therein, a memory unit 126 having switches therein, a switch 130*d*, and a switch controller 132 to which switch control data is applied from external circuitry. Since the second embodiment is an extension of the first embodiment, the second embodiment will be described with reference to the first embodiment.

Figure 10:
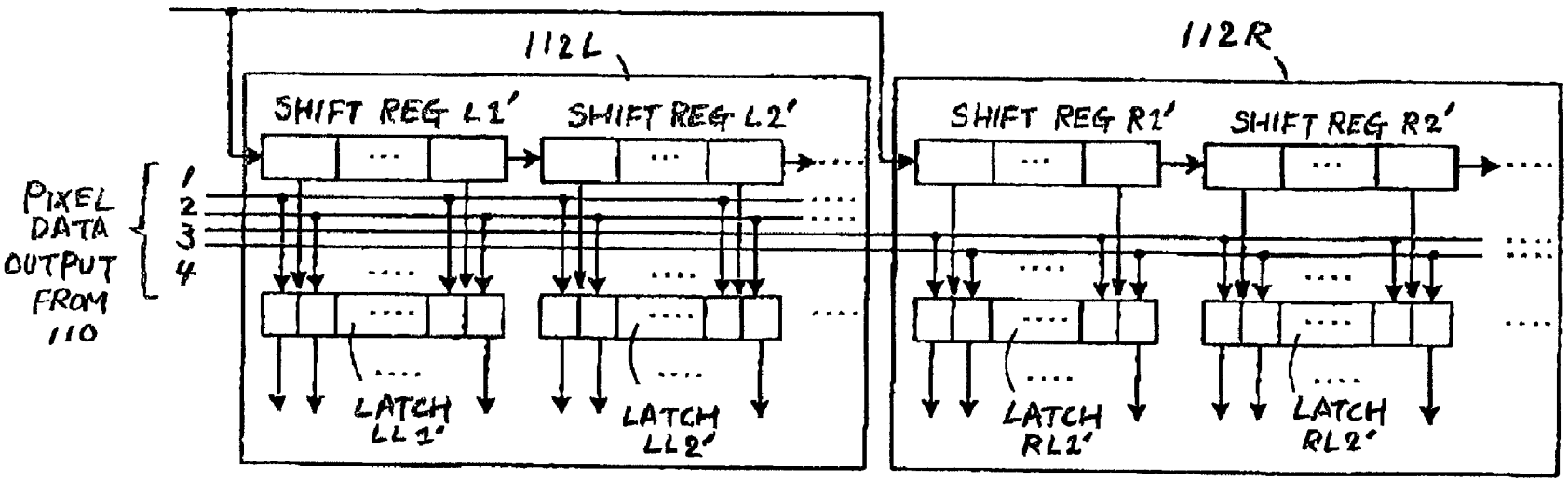
FIG. 10 is a block diagram showing part of source drivers used with the second embodiment of the present invention.
Figure 11A:
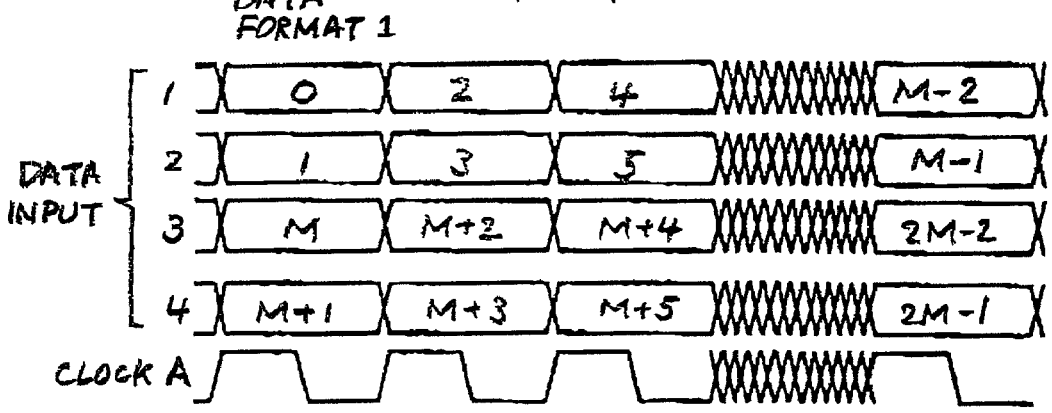
FIGS. 11A to 11F are each showing a timing chart for describing the operations of the second embodiment of the present invention.
Figure 11B:
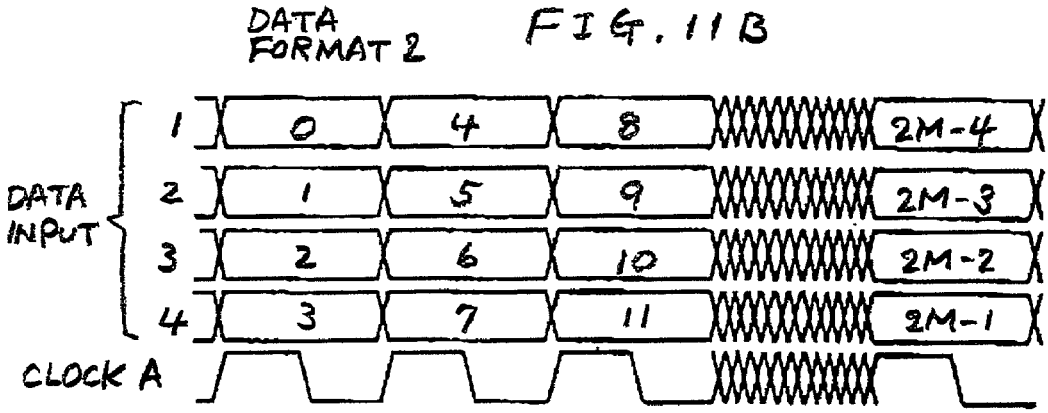
Figure 11C:
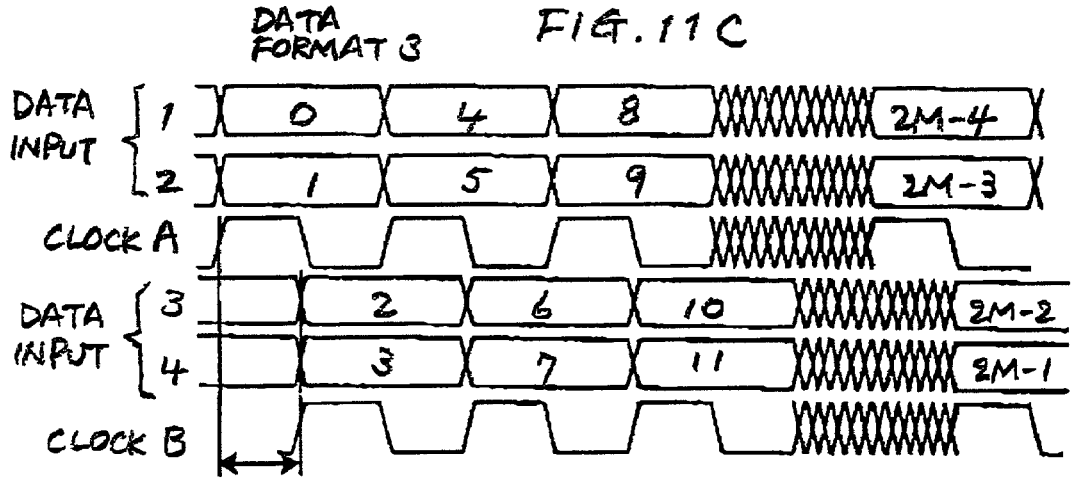
Figure 11D:
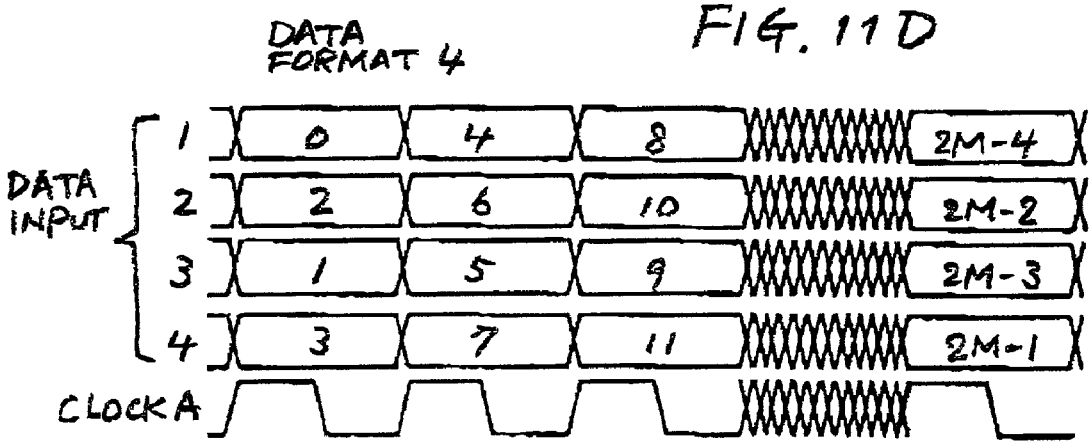
Figure 11E:
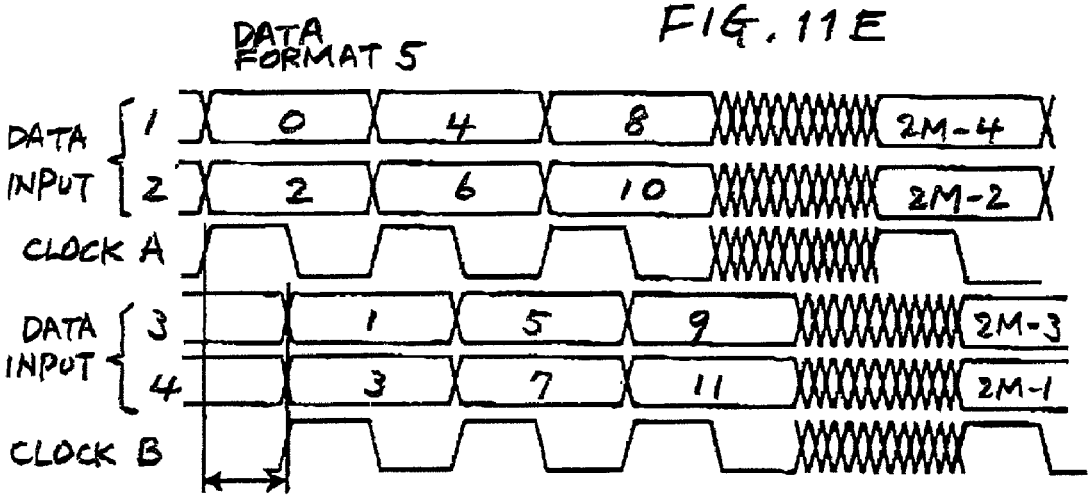
Figure 11F:
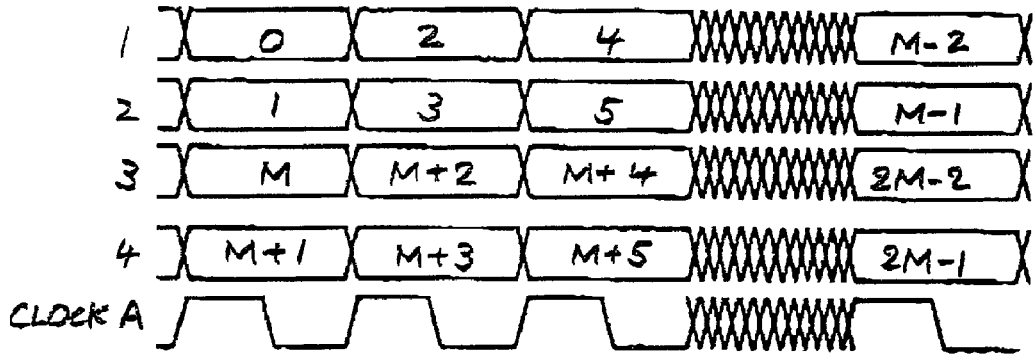

The pixel data outputs 1 to 4 to be generated from the circuit 110, are shown in FIG. 11F and applied to source driver groups 112L and 112R of FIG. 10. The pixel data outputs 1–2 and 3–4 are respectively assigned to the left and right halves of the LCD panel.

FIG. 10 shows a part of each of the source drivers 112L and 112R, and corresponds to FIG. 8. As in FIG. 10, a start signal (viz., horizontal sync signal) is applied to the first stage of each of shift registers L1' and R1', after which the start signal is shifted (displaced) to the right and then to the next shift register L2' and R2' respectively in response to the timing clock (clock A). As mentioned above, since the pixel data outputs 1–2 and 3–4 are respectively assigned to the source drivers 112L and 112R, it is possible to latch two consecutive pixel data at a time. Therefore, the number of stages of each of the shift registers L1', R1', etc. can be halved. The sync signal thus shifted is applied to corresponding two consecutive stages of latches LL1', ;1LL2', . . . , and RL1', RL2', . . . . Therefore, a pair of pixel data of each of the data outputs 1–2 and 3–4 from the circuit 110 is latched simultaneously. The following operations are identical to those already described with respect to FIG. 8.

In the case where the pixel data inputs 1–4 are applied to the circuit 110 being formatted shown in FIG. 11A, there is no need to rearrange the order of pixel data in that the inputs 1–4 are arranged as indicated in FIG. 11F. In this case, the switch controller 132 controls only the switch 130*d* so as to path therethrough the data inputs 1–4. The switch 130*d* corresponds to the switch 13*d* of FIG. 3A. It is understood that the switch controller 132 does not control a switch unit 124*s* in the data phase adjuster 124. The switch unit 124*s* is provided to allow the data inputs applied thereto to pass therethrough as mentioned later. Further, in the above case, the switch controller 132 does not control a switch unit 126*s* in the memory unit 126. The switch unit 126*s* functions as the switch 30*c* of FIG. 3A.

When the pixel data inputs 1–4 take the formats shown in FIG. 11B, the switch controller 132 sets the switch 124*s* so as to pass the applied data inputs 1–4 through the data phase adjuster 124 because there is no need to carry out data phase delay of the data inputs 1 and 2. Although not shown in FIG. 9, the memory unit 126 is in fact provided with 16 line memories, the number of which is doubled compared with the first embodiment because the number of data inputs is doubled. The operations of rearranging the orders of the data inputs 1–4 can be understood from the descriptions made with respect to FIGS. 5–7. That is to say, the difference between the first and second embodiments resides in the fact that the number of data inputs and outputs are doubled.

In the case where the pixel data inputs 1–4 take the formats shown in FIG. 11C, the switch controller 132 sets the switch 124*s* so as to apply the data inputs 1–4 to the data phase adjuster 124 because it is necessary to delay the inputs 1–2 by ½ clock. It is to be noted that the inputs 3–4 are subject to no data phase adjustment. The data inputs 1–2 thus delayed are applied to the memory unit 126 together with the non-delayed inputs 3–4. The following operations are identical to those executed on the data inputs 1–4 shown in FIG. 11B.

In connection with the pixel data inputs 1–4 formatted as shown in FIG. 11D, the operations of rearranging the data orders are substantially identical to those carried out with the data inputs 1–4 shown in FIG. 11B. The difference between the two cases (FIGS. 11D and B) is that the line memories to be selected under the control of the timing clock by the switch 130*d* are different.

When the pixel date inputs 1–4 take the formats shown in FIG. 11E, the switch controller 132 sets the switch 124*s* so as to apply the data inputs 1–4 to the data phase adjuster 124 because it is necessary to delay the inputs 1–2 by ½ clock as in the case of FIG. 11C. The data inputs 1–2 thus delayed are applied to the memory unit 126 together with the non-delayed inputs 3–4. The following operations are identical to those carried out on the data inputs 1–4 shown in FIG. 11D.

A third embodiment of the present invention will be described with reference to FIGS. 12A–12C. When the LCD panel is under test and/or fault diagnosis in a laboratory or a quality control section, it is sometimes desirable to check the left and right halves of the LCD panel using the same data. Further, it is sometimes sufficient to display the same data on the left and right halves of the panel under test so as to check the operations of the display panel. To this end, according to the third embodiment, the identical pixel data are displayed on the left and right halves of the LCD panel using the pixel data rearrangement circuit 10 or 110.

Figure 12A:
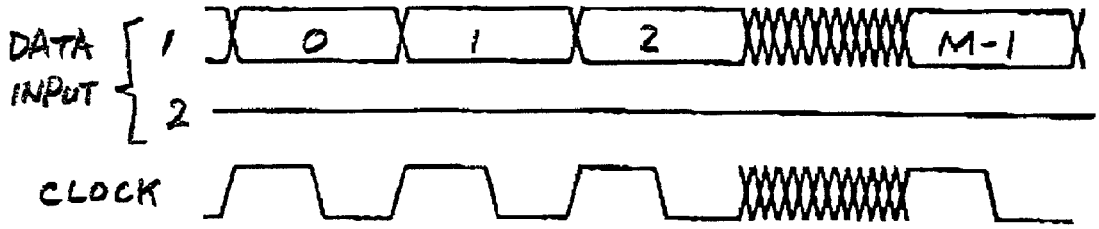
FIGS. 12A to 12C are each showing a timing chart for describing a third embodiment of the present invention.
Figure 12B:
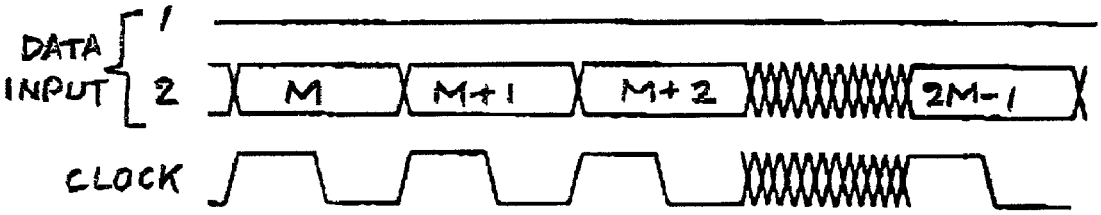
Figure 12C:
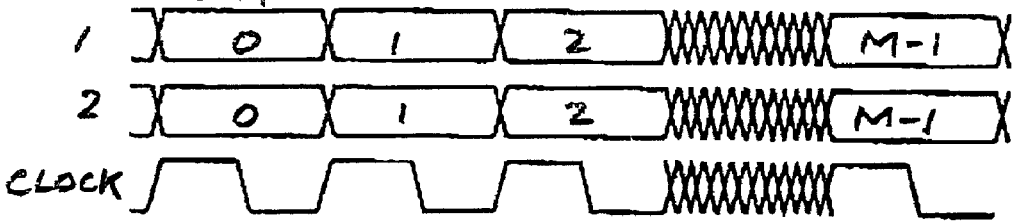

FIG. 12A shows that only the pixel data input 1 is applied to the circuit 10, while FIG. 12C shows the outputs of the circuit 10. In this case, the line memories 1 and 2 referred to with the first embodiment stores the same pixel data 0, 1, 2, . . . , M−1 of the first half of the first line of the input 1, after which the circuit 10 controls the switches 30*a*, 30*b* and 30*d* so as to generate the pixel data shown in FIG. 12C, and thus, the same data are applied to the source driver groups 12L and 12R. The same discussion is applicable to the case when only the data input 2 shown in FIG. 12B is applied to the circuit 10. It goes without saying that the data rearrangement circuit 110 can be used to receive a single pixel data and generate the data shown in FIG. 12C.

A fourth embodiment of the present invention will be described with reference to FIGS. 13A–13C. When the LCD panel is under test and/or fault diagnosis in a laboratory or a quality control section, it is sometimes desirable to check while displaying the pixel data normally assigned to one half of the panel over the entire line. This can be realized by displaying each pixel data at the two adjacent pixel cells. This technique is preferable when checking the gray level changes over the whole horizontal line of a high pixel density panel because the gray level changes can be reduced.

Figure 13A:
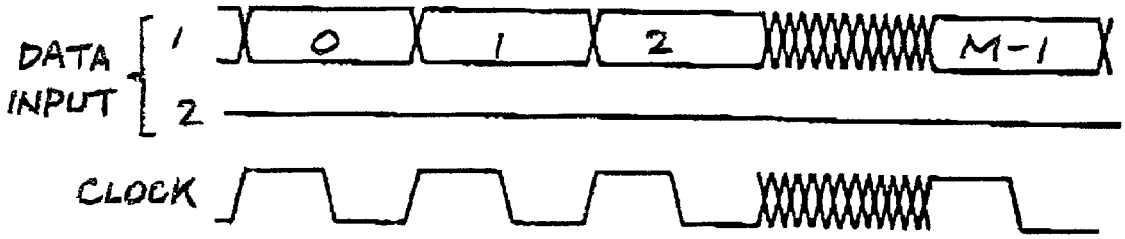
FIGS. 13A to 13C are each showing a timing chart for describing a fourth embodiment of the present invention.
Figure 13B:
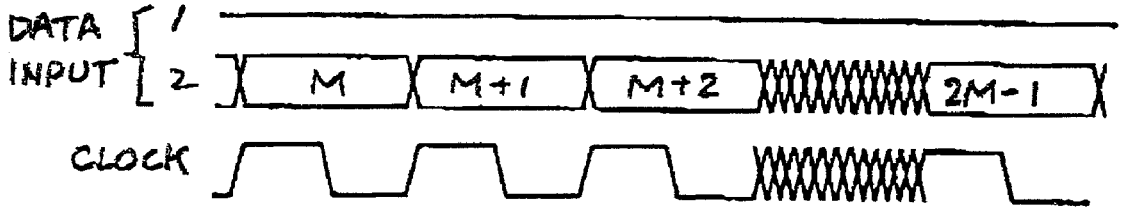
Figure 13C:
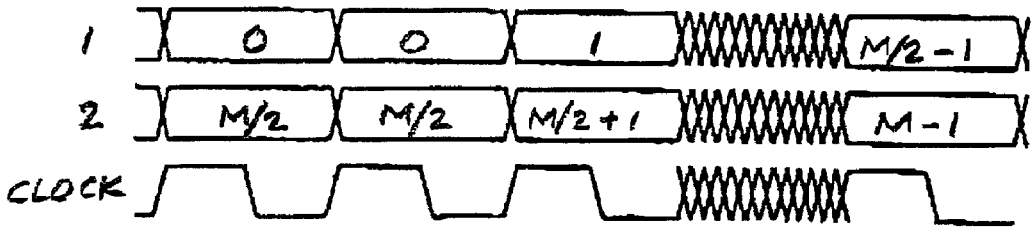

FIG. 13A shows that only the pixel data input 1 is applied to the circuit 10, while FIG. 13C shows the outputs of the circuit 10. In this case, the line memories 1 and 2 stores the same pixel data 0, 1, 2, . . . , M−1 of the first half of the first line of the input 1, after which the circuit 10 controls the switches 30*a*, 30*b* and 30*d* so as to generate the pixel data shown in FIG. 13C, and thus, the same pixel data are applied to the two adjacent source drivers 12 of each of the source driver groups 12L and 12R. The same discussion is applicable to the case when only the data input 2 as shown in FIG. 13B is applied to the circuit 10. It is understood that the data rearrangement circuit 110 can be used to receive a single pixel data and generate the data shown in FIG. 13C.

As mentioned above, the preferred embodiments have been described on the assumption that the number of each of the pixel data inputs and outputs is two and four. However, the present invention can be applied to the case where the number of each of the data inputs and outputs is 2N (N is a natural number more than 2). Further, the data phase adjusting is not necessarily implemented within the data rearrangement circuit 10 (or 110), in the case of which the phase adjuster 24 (or 124) is provided at the position following the switch 30*d* (130*d*), such as indicated by data phase adjuster 24' shown in dashed lines (indicating an alternative position) in FIG. 3A.

The foregoing descriptions show four preferred embodiments and some modifications thereof. However, other various modifications are apparent to those skilled in the art without departing from the scope of the present invention which is only limited by the appended claims. Therefore, the embodiments and modification shown and described are only illustrated, not restrictive.

What is claimed is:

1. A liquid crystal display (LCD) unit, comprising:

an LCD panel;

a plurality of source drivers functionally divided into first and second source driver groups which are respectively assigned to first and second halves of the LCD panel; and a pixel data rearrangement circuit preceding the first and second source driver groups, the pixel data rearrangement circuit simultaneously receiving 2N-path (N is a natural number) pixel data and rearranging the orders of the 2N-path pixel data according to a predetermined data format and applying rearranged first N-path pixel data to the first source driver group and applying rearranged second N-path pixel data to the second source driver group, wherein the pixel data rearrangement circuit comprises, memory means having a plurality of line memories into which the 2N-path pixel data are stored;

first switch means for selectively reading the 2N-path pixel data from the line memories under control of switch control signals; and second switch means for rearranging the orders of the 2N-path pixel data selectively read out of the line memories.

2. The liquid crystal display unit as claimed in claim 1, wherein the pixel data rearrangement circuit further comprises:

a data phase adjuster for delaying one or more of the 2N-path pixel data so as to eliminate phase difference between the one or more of the 2N-path pixel data and the pixel data of the remaining paths.

3. The liquid crystal display unit as claimed in claim 1, further comprising a data phase adjuster provided between the pixel data rearrangement circuit and the plurality of source drivers, the data phase adjuster delaying one or more of rearranged 2N-path pixel data outputted from the pixel data rearrangement circuit so as to eliminate phase difference between the one or more of the rearranged 2N-path pixel data and the rearranged pixel data of the remaining paths outputted from the pixel data rearrangement circuit.

4. The liquid crystal display unit as claimed in claim 1, wherein the pixel data rearrangement circuit receives a single-path pixel data assigned to one of the first and second halves of the LCD panel and generates two-path pixel data each of which is identical to the single-path pixel data, the two-path pixel data respectively applied to the first and second source driver groups.

5. The liquid crystal display unit as claimed in claim 1, wherein the pixel data rearrangement circuit receives a single-path pixel data assigned to one of the first and second halves of the LCD panel and generates two-path pixel data by doubling each pixel data of the single-path pixel data, each of the two-path pixel data respectively applied to the first and second source driver groups.

6. A liquid crystal display (LCD) unit having a pixel data rearrangement circuit, the pixel data rearrangement circuit comprising:

a plurality of pixel data inputs whose number is 2N (N is a natural number) and that simultaneously receive 2N-path pixel data;

a data phase adjuster for eliminating phase difference between the 2N-path pixel data received at the plurality of pixel data inputs if the phase difference exists;

memory means for storing the 2N-path pixel data received at the plurality of pixel data inputs, wherein the memory means, if the phase difference exists, is operatively coupled to receive the output of the data phase adjuster;

first switch means for selectively reading the pixel data stored in the memory means; and second switch means, which follows the first switch means, for rearranging the orders of the pixel data according to a predetermined data format, applying rearranged first N-path pixel data to a first source driver group assigned to one half of an LCD panel, and applying rearranged second N-path pixel data to a second source driver group assigned to the other half of the LCD panel.

7. A liquid crystal display (LCD) unit having a pixel data rearrangement circuit, the pixel data rearrangement circuit comprising:

a plurality of pixel data inputs whose number is 2N (N is a natural number) and that simultaneously receive 2N-path pixel data;

memory means for storing the 2N-path pixel data received at the plurality of pixel data inputs;

first switch means for selectively reading the pixel data stored in the memory means; and second switch means, which follows the first switch means, for rearranging the orders of the pixel data according to a predetermined data format, applying rearranged first N-path pixel data to a first source driver group assigned to one half of an LCD panel, and applying rearranged second N-path pixel data to a second source driver group assigned to the other half of the LCD panel, wherein if a phase difference exists between the first and second N-path pixel data outputted from the second switch means, the phase difference is eliminated before being applied to the LCD panel.

* * * * *